United States Patent [19]

Stettiner et al.

[11] Patent Number: 4,959,865

[45] Date of Patent: Sep. 25, 1990

[54] A METHOD FOR INDICATING THE PRESENCE OF SPEECH IN AN AUDIO SIGNAL

[75] Inventors: Yoram Stettiner, Ramat-Hasharon; Shabtai Adlersberg, Petah-Tikva; Mendel Aizner, Rishon-Le-Zion, all of Israel

[73] Assignee: The DSP Group, Inc., Emeryville, Calif.

[21] Appl. No.: 151,740

[22] Filed: Feb. 3, 1988

[30] Foreign Application Priority Data

Dec. 21, 1987 [IL] Israel ..... 84902

[51] Int. Cl.[5] ..... G10L 7/02

[52] U.S. Cl. ..... 381/46

[58] Field of Search ..... 381/46–47, 381/41–45, 49, 110; 369/513.5; 379/80; 455/116

[56] References Cited

U.S. PATENT DOCUMENTS

| | | | |
|---|---|---|---|
| 3,832,491 | 8/1974 | Sciulli et al. | 179/1 VC |
| 4,015,088 | 3/1977 | Dubnowski et al. | 381/49 |
| 4,052,568 | 10/1977 | Jankowski | 179/15 AS |
| 4,187,396 | 2/1980 | Luhowy | 179/15 C |
| 4,388,491 | 6/1983 | Ohta et al. | 381/49 |
| 4,484,344 | 11/1984 | Mai et al. | 381/46 |
| 4,561,102 | 12/1985 | Prezas | 381/49 |
| 4,625,083 | 11/1986 | Poikela | 381/46 |
| 4,653,098 | 3/1987 | Nakata et al. | 381/49 |
| 4,715,065 | 12/1987 | Parker | 381/46 |
| 4,803,730 | 2/1989 | Thomson | 381/49 |
| 4,845,753 | 7/1989 | Yasunaga | 381/49 |

*Primary Examiner*—Gary V. Harkcom
*Assistant Examiner*—John A. Merecki
*Attorney, Agent, or Firm*—Townsend and Townsend

[57] ABSTRACT

A voice operated switch employs digital signal processing techniques to examine audio signal frames having harmonic content to identify voiced phonemes and to determined whether the signal frame contains primarily speech or noise. The method and apparatus employ a multiple-stage, delayed-decision adaptive digital signal processing algorithm implemented through the use of commonly available electronic circuit components. Specifically the method and apparatus comprise a plurality of stages, including (1) a low-pass filter to limit examination of input signals to below about one kHz, (2) a digital center-clipped autocorrelation processor whih recognizes that the presence of periodic components of the input signal below and above a peak-related threshold identifies a frame as containing speech or noise, and (3) a nonlinear filtering processor which includes nonlinear smoothing of the frame-level decisions and incorporates a delay, and further incorporates a forward and backward decision extension at the speech-segment level of several tenths of milliseconds to determine whether adjacent frames are primarily speech or primarily noise.

11 Claims, 4 Drawing Sheets

A METHOD FOR INDICATING THE PRESENCE OF SPEECH IN AN AUDIO SIGNAL

BACKGROUND OF THE INVENTION

This invention relates to voice-triggered switching and more particularly to a method and apparatus for producing a speech indication signal in response to detection of voice information in the presence of extreme spurious background signals. A voice operated switch is useful for voice-triggered control of equipment such as telephone and radio transmitters as well as an element of a speech enhancement apparatus requiring separation of time frames containing speech from time frames containing undesired audio information in extremely noisy environments.

Prior voice operated switches have employed various techniques and primarily analog signal detection techniques.

Poikela U.S. Pat. No. 4,625,083 describes a two-microphone voice-operated switch (VOX) system which seems to suggest autocorrelation of signals in an analog sense through the use of a differential amplifier for comparing the signals from the two microphones. This technique is reminiscent of noise cancellation microphone techniques and is not particularly pertinent to the present invention.

Mai et al. U.S. Pat. No. 4,484,344 is a syllabic rate filter-based voice operated switch. It employs input signal conditioning through an analog low-pass filter to limit examination of signal content to below 750 Hz.

Luhowy U.S. Pat. No. 4,187,396 describes an analog voice detector circuit employing a syllabic rate filter. It uses a hangover time function operative as an envelope detector.

Jankowski U.S. Pat. No. 4,052,568 describes a digital voice switch using a digital speech detector and a noise detector operating on broad spectrum speech signals. It also teaches the hangover time function and dual threshold detection.

Sciulli U.S. Pat. No. 3,832,491 describes an early digital voice switch wherein a digital adaptive threshold is employed based on the number of times the amplitude of talker activity exceeds an amplitude threshold per unit time.

SUMMARY OF THE INVENTION

According to the invention, a voice operated switch employs digital signal processing techniques to examine audio signal frames having harmonic content to identify voiced phonemes and to determine whether a selected segment contains primarily speech or noise. The method and apparatus employ a multiple-stage, delayed-decision adaptive digital signal processing algorithm implemented through the use of commonly available DSP electronic circuit components. Specifically the method and apparatus comprise a plurality of stages, including (1) a low-pass filter to limit examination of input signals to below about one kHz, (2) a digital center-clipped autocorrelation processor which recognizes that the presence of periodic components of the input signal below and above a peak-related threshold identifies a time invariant frame as containing speech or noise, and (3) a nonlinear filtering processor which includes nonlinear smoothing of the frame-level decisions and incorporates a delay, and further incorporates a forward and backward decision extension at the speech-segment level.

The invention will be better understood by reference to the following detailed description taken in conjunction with the accompanying drawings.

DESCRIPTION OF SPECIFIC EMBODIMENTS

The invention may be realized in hardware or in software incorporated in a programmed digital signal signal processing apparatus. For example, the voice operated switch may be realized as an element of other devices employing digital signal processing techniques. It is contemplated for specific applications that the invention is realized in a dedicated device constructed around a microprocessor such as a Motorola 68000 enhanced by supplemental digital signal processing components such as a TMS 320 Series device from Texas Instruments. Realizations employing other components are contemplated without departinq from the spirit and scope of the invention.

Figure 1:
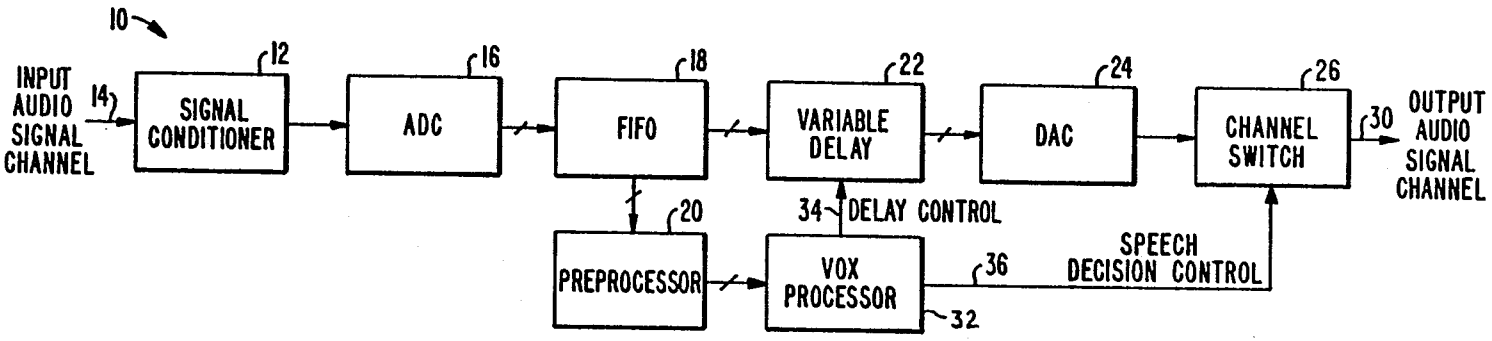
FIG. 1 is a block diagram of an apparatus employing a voice operated switching means in accordance with the invention.

Referring to FIG. 1 there is shown a block diagram of a voice operated switch (VOX) controlled apparatus 10 illustrating the major functions of a voice operated switch according to the invention. The VOX controlled apparatus 10 comprises a signal conditioning means 12 coupled to receive audio signal input through an audio channel 14 and to provide controlled attenuation signals to the next stage. The next stage is an analog to digital converter (ADC) 16 for converting analog signals to digital samples. The output of the ADC 16 is coupled to a first in first out buffer (FIFO) 18 which adds a delay needed for reliable operation of subsequent stages. Outputs from the FIFO 18 are coupled to a preprocessor 20 and to a variable delay 22. The output of the variable delay 22 is coupled to a digital to analog converter (DAC) 24, the output of which is coupled to a channel switch 26. The output of the channel switch is provided to an output audio signal channel 30. When the voice operated switch control is invoked, voice switched audio is generated. Otherwise the audio channel simply passes a conditioned audio signal containing speech and noise.

Voice operated switching is implemented by processing information extracted by the preprocessor 20, the output of which is provided to a VOX processor 32. The preprocessor 20 and VOX processor 32 may considered together as constituting a voice operated switch. Two control outputs are provided from the VOX processor 32, a first or delay control output 34 and a second or speech decision control output 36.

Referring now in greater detail to the signal conditioner 12 in FIG. 1, the signal conditioner 12 is preferably an automatic gain control apparatus having approximately 50 dB dynamic range. For example the AGC may comprise an array of attenuators whose attenuation is controlled interactively based on estimates of the peak energy during signal intervals. The AGC may be more tightly controlled by basing the attenuation decision only on those intervals determined by the VOX processor to contain speech.

The ADC 12 may be a conventional linear 12-bit converter with an anti-aliasing filter or it may be an A-law or MU-law codec as employed in digital telephony. A sampling rate of 8000 samples per second is suitable for speech processing. The DAC 24 is for reconstruction of the analog signal for utilization and is of a form complementary to the form of the ADC 16.

The FIFO 18 is a digital delay line introducing a delay of approximately ¼ second (250 ms). The preprocessor 20, as explained hereinafter, conditions the samples and groups them in an overlapping sequence of frames for use in the VOX processor 32. The VOX processor 32, as explained hereinafter, renders the speech/no-speech decision.

The variable delay 22 is provided to account for changes in parameters affecting the delay introduced by the VOX processor 32. The channel switch is closed by the VOX processor 32 to pass speech segments and is opened to block non-speech segments.

The apparatus of FIG. 1 is intended to be descriptive and not limiting as to specific features of the invention, and it illustrates one embodiment of a device considered to be a voice operated switch. The actual switching decision is incorporated into the elements designated as the VOX processor 32.

Figure 2:
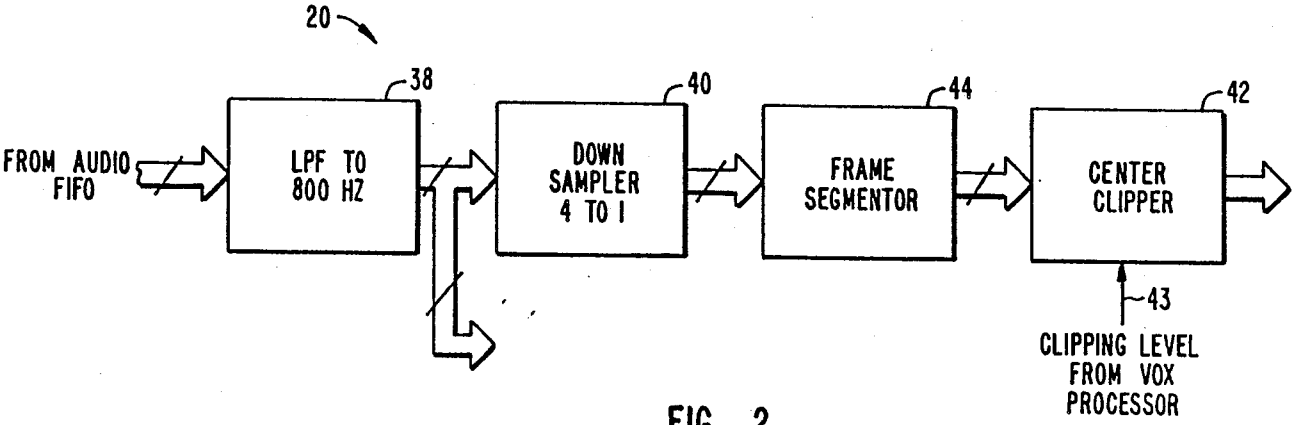
FIG. 2 is a block diagram of a preprocessor according to the invention.

Referring to FIG. 2 there is shown a block diagram of a preprocessor 20 in accordance with the invention. The preprocessor 20 prepares the digitized input signal for processing in the VOX processor 32. According to the invention, the VOX processor 32 makes preliminary decisions on the presence of speech in an audio signal on the basis of pitch information in invariant voiced speech segments of about 16 ms duration, and then it accounts for limitations of this decision technique by compensating over extended look-forward and look-backward periods to provide for continuity and for leading and trailing unvoiced speech.

The preprocessor 20 comprises a low-pass filter 38, a down sampler 40, a center clipper 42 and a frame segmenter 44. The low-pass filter 38 is coupled to receive digital signals from an selected stage of the FIFO 18 and to pass a filtered digital signal to the down sampler 40. The down sampler 40 is coupled to the frame segmenter 44. The frame segmenter 44 output is coupled to the input of the center clipper 42. The output of the center clipper 42 is coupled to the input of the VOX processor 32 as hereinafter explained.

The low-pass filter 38 is a digital filter having a cutoff frequency of less than 1000 Hz and preferably of 800 Hz in order to improve signal-to-noise characteristics of the useful pitch in the spectrum of 50 Hz to 500 Hz where most of the pitch frequencies of a voiced phoneme are known to be in real-time conventional speech.

The down sampler 40 is a mechanism for decimating the resultant filtered signal. No longer is it necessary to retain a resolution of 8000 samples per second, since the effective bandwidth is only about 800 Hz. Hence the the down sampler 40 functions to discard for example three out of every four samples while retaining sufficient information on which to render the desired decision on a signal of the remaining bandwidth. The complexity of the signal processing is also thereby reduced. (However, the filtered but undecimated signal may be retained for use in selected precision processing, such as autocorrelation.)

The frame segmenter 44 implements a segmentation process in order to segment the stream of digital audio samples into useful processing frames. Specifically, the digital audio samples are assembled in the frame segmenter 44 into frames containing preferable 50% overlap between successive intervals. Frame length is selected to be 256 samples or 32 ms in length in the preferred embodiment. A frame level decision is generated every 16 ms. Because of the overlap the transitions to and from voiced speech segments are handled more smoothly, and second level decisions have available to them twice as many frame level decisions.

The center clipper 42 is a spectrum flattener operative to remove the effect of the vocal tract transfer function and to constrain each harmonic of the fundamental to approximately the same amplitude. The specific procedure comprises finding the peak amplitude during the first third of the segment (i.e., the 32 ms speech segment) and during the last third of the segment and then setting the clipping level at a fixed percentage of the minimum of these two measured maxima. The clipping level input 43, which is a parameter provided by the VOX processor 32 is preferably set to about 0.65 of the lower maxima. A detailed description of the center clipping technique is given in the book by L.R. Rabiner and R.W. Schafer, *Digital Processing of Speech Signals*, pp. 150–154, 1978, (Prentice-Hall, Inc, Englewood Cliffs, N.J. 07632).

To understand the need for a center clipper it is useful to review the classical model of speech generation. Speech generation is considered to involve an excitation of the vocal cords which causes vibration for voiced speech and "white-noise"-like sounds for unvoiced speech. When the vocal cords vibrate at the pitch frequency, they generate an impulse train at the pitch frequency which can be described in terms of a vocal tract transfer function introducing frequency selective attenuation. The corresponding power spectrum is concentrated primarily at discrete frequencies which are harmonics of the fundamental pitch frequency, and the envelope of the spectrum exhibits peaks and valleys. The peaks of the spectrum are known as "formant frequencies", and they correspond to the resonant frequencies of the vocal tract.

According to the invention, the VOX processor 32 capitalizes on the presence of pitch within voiced speech to render its decision about the presence or absence of speech within an audio signal. However, if the excitation or pitch is to be emphasized to enhance its detectability, it is preferable and believed necessary to remove the formant frequency structure from the speech spectrum prior to detection. In the particular type of VOX processor employed, a short-time autocorrelation function is used to detect for the periodicity of the pitch, so that other signal peaks in the voiced speech spectrum are extraneous and will cause false readings because the autocorrelation peaks due to periodic oscillation are higher than the autocorrelation peaks due to the periodicity of vocal excitation, particularly where the readings are based on selection of the highest peak in a segment. To minimize this problem it is desirable to process the speech signal so as to make the periodicity more prominent while suppressing the peaks due to other factors. Hence the spectrum flattening technique of a center clipper is employed according to the invention as explained hereinabove.

Figure 3:
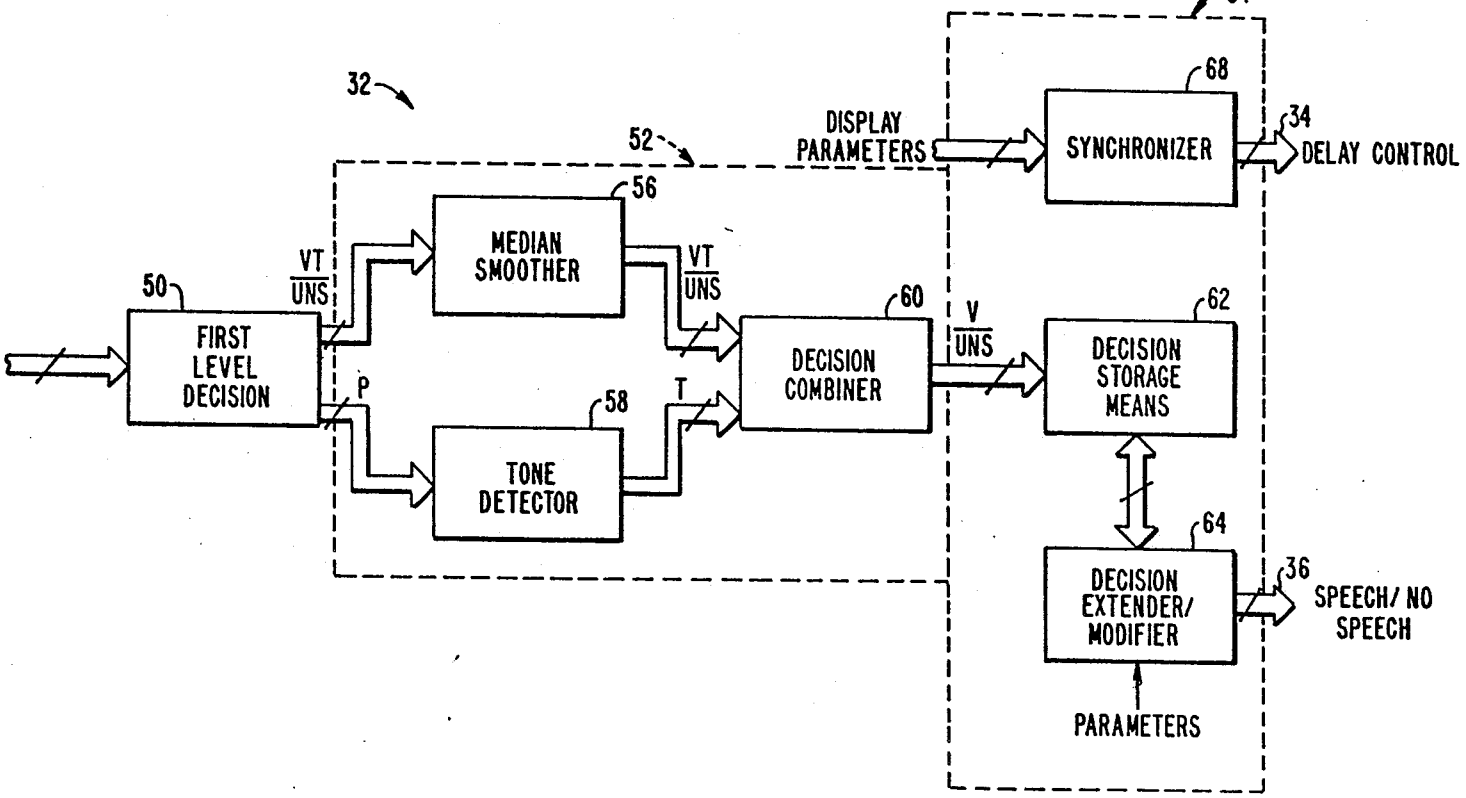
FIG. 3 is a block diagram of a VOX processor in accordance with the invention.

Referring to FIG. 3 there is shown a block diagram of a VOX processor 32 in accordance with the invention. The VOX processor 32 is best described in terms of the algorithms of the corresponding software implementation of the invention. The VOX algorithm employs first level decision means 50, second level decision means 52 and third level decision means 54. The first level decision means 50 operates on the single overlapping frame to estimate whether the frame is voiced speech in a first category or unvoiced speech, noise or silence in a second category. The first level algorithm employs pitch as an indicator to determine whether the input frame comprises (1) voiced speech V or tone T, or (2) unvoiced speech U or noise N or silence S, providing the binary decision to a first element 56 of the second level decision means 52. The first level decision means 50 also extracts pitch information P and supplies the extracted tone T to a delayed tone detector element 58 of the second level decision means 52. The first element 56 receiving the VT/UNS decision is a median smoother 56, that is, a nonlinear filter used for smoothing decisions and for passing decisions indicative of sharp, consistent transitions. The delayed decision tone detector 58 is a detector for detecting the presence of a constant frequency tone in the 50 Hz to 500 Hz range having a duration of more than several frames. The output of the median smoother 56 and the delayed decision tone detector 58 are coupled to a decision combiner 60 wherein the decision is made to block the voice decision if the tone output decision T of the tone detector 58 coincides with the voice/tone output decision VT of the median smoother 56.

The third level decision means 54 operates over several frames. Hence all second level decisions are stored in a decision storage means 62 to provide for the delay necessary for third level decisions. The decision storage means interacts with a decision extender/modifier 64 which provides the final speech or no speech decision for each overlapping frame. The decision extender/-modifier 64 is intended to eliminate extremely short speech segments, indicative of false detection of speech, to extend second-level decision making such that unvoiced speech segments are included in the decision if adjacent to voiced speech segments, to fill in short silence gaps, and to provide hang-time delays and the like. A synchronizer 66 is employed to assure that equivalent delays are provided between the FIFO 18 and the VOX processor 32. The synchronizer 66 controls the variable delay 22.

Figure 4:
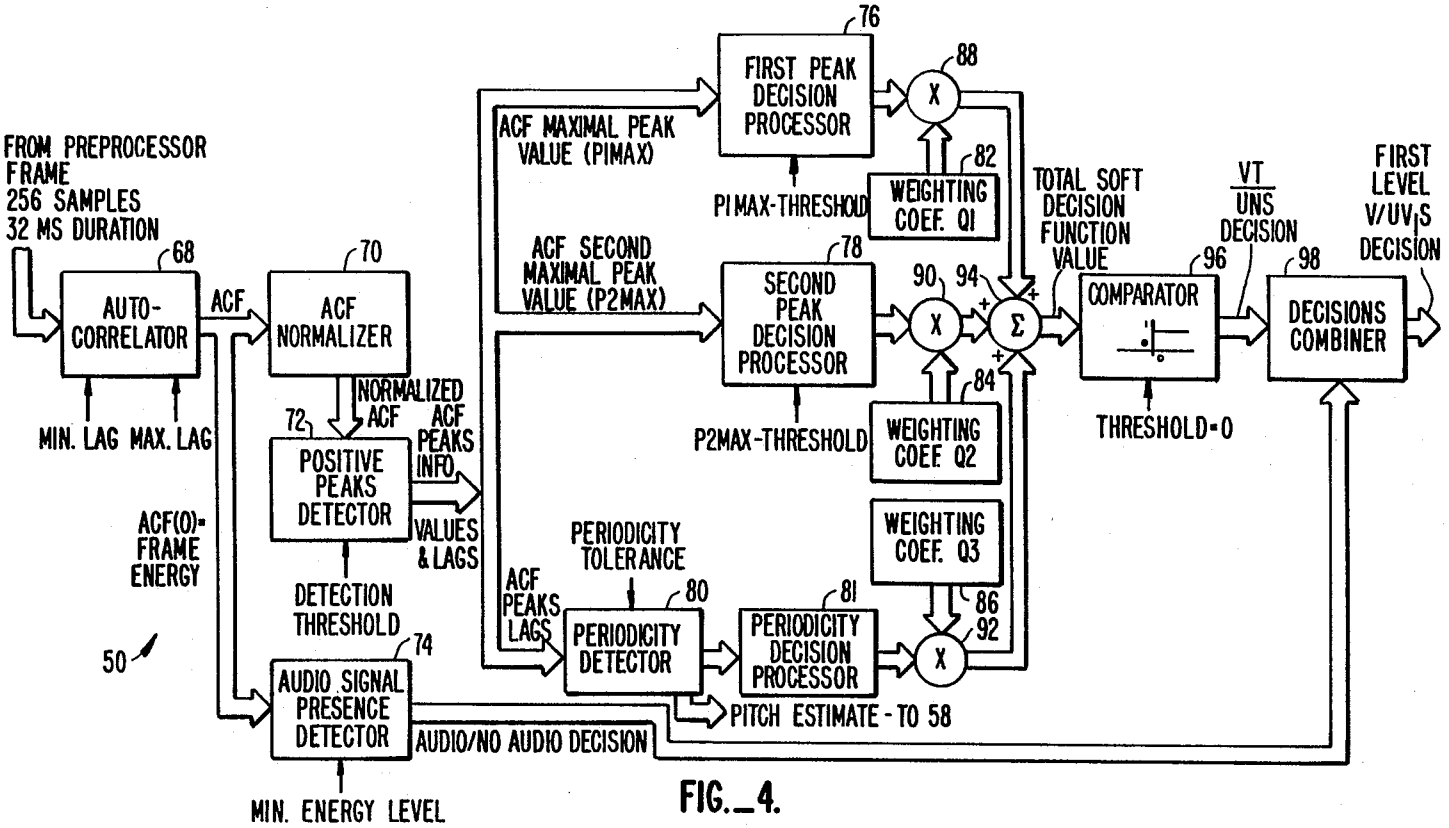
FIG. 4 is a detailed block diagram of a first level decision means according to the invention.

Referring to FIG. 4 there is shown a detailed block diagram of a first level decision means 50 according to the invention. The first level decision means 50 comprises an autocorrelator (ACF) 68, an ACF normalizer 70, a positive peaks detector 72, an audio signal presence detector 74, a first peak decision processor 76, a second peak decision processor 78, a periodicity detector 80, a periodicity function processor 81, selected weighting functions 82, 84 and 86 and multipliers 88, 90 and 92, a summer 94 for summing the weighted combination of the outputs of the first peak decision processor 76, the second peak decision processor 78 and the periodicity function processor 80, a comparator 96 and a decisions combiner 98.

The autocorrelator 68 in the preferred embodiment is coupled to receive from the frame segmenter 44 of the preprocessor 20 a 32 ms long overlapping frame of 256 samples decimated to 64 samples, to calculate the non-normalized autocorrelation function between a minimum lag and a maximum lag and to provide the resultant autocorrelation function ACF(k), k=min,...,max, to the ACF normalizer 70 and the audio signal presence detector 74. The preferred minimum lag is 4, corresponding to a high pitch of 500 Hz, and the preferred maximum lag is 40, corresponding to a low pitch of 50 Hz. The ACF at lag zero (ACF(0)) is known as the "frame energy."

The audio signal presence detector 74 employs as a parametric input a minimum energy level (4–5 bits of a 12 bit signal) to detect for a "no audio" condition in the frame energy (ACF(0)). Indication of an audio/no audio condition is supplied to the decision combiner 98. This is the only stage in the decision process where signal level is a criterion for decision.

The ACF normalizer 70 receives the autocorrelator 68 output signal and normalizes the energy and the envelope. Energy normalization is effected by dividing the normalization function output for k=min lag to k=max lag by the frame energy ACF(0). Envelope normalization is effected by multiplication of the ACF by an inverse triangle factor which results in a rectangular envelope to the ACF instead of a triangular envelope rolloff characteristic of an ACF.

The positive peaks detector 72 detects for a preselected number of peaks in excess of a normalized threshold and then calculates more precisely the value of the ACF and the lag of each peak. A preferred normalized threshold is in he range of 0.1 to 0.2. The output, in the form of a list of peaks with ACF values and lags, is provided to the first peak decision processor 76, the second peak decision processor 78 and the periodicity detector 80

The first peak decision processor 76 receives as its input the value of the maximum ACF peak and renders a positive decision output if the value exceeds a preselected threshold P1MAX-T, indicating the presence of a pitch in the signal. A nonlinear function is applied to reflect the probability that pitch is present at various levels of P1MAX. Typical values for P1MAX-T is 0.4 to 0.6, with decreasing values increasing the probability of detection of speech and of false alarms.

The second decision processor 78 is an identical nonlinear function to the first decision processor 76 except that it receives as input the second highest ACF peak and uses as its threshold P2MAX-T between 0.35 and 0.55, that is, a threshold scaled for the second ACF peak.

The periodicity detector verifies the periodicity of the ACF peaks. For a voiced frame, the lags of the ACF peaks should form an arithmetic sequence with zero as the first element and the difference between each element in the sequence corresponding to the pitch period. A lag tolerance accounts for the difference between an ideal sequence and a detected sequence. The periodicity detector 80 provides as output the following values: (1) The theoretical number of peaks computed by dividing the maximum lag by the lag of the first peak (TNPKS); (2) The actual number of peaks forming an approximated arithmetic sequence (less the peak at zero lag) (ANPKS); and (3) a pitch period estimate or sequence difference. The pitch period estimate is passed to the pitch consistency detector (a tone detector) of the second level decision means 52 while the other values are provided to the periodicity decision processor 81.

The periodicity decision processor 81 accepts the above output parameters and assigns a value to each combination from a lookup table indicative of the probability that the signal received is periodic. No specific algorithm is applied in the preferred embodiment, as the values are primarily empirical corrections to the periodicity detector 80.

The outputs of each of the decision processors 76, 78 and 81 are soft decisions indicative of the probability that a voiced segment or a tone (pitch) has been detected. In order to enhance the flexibility of the resultant decision, there is associated with each soft decision a weighting coefficient 82, 84 and 86 which respectively weights the value of the soft decisions by multiplication through multipliers 88, 90 and 92 of the respective outputs. The respective outputs are summed at the summer 94 and supplied to the comparator 96 whose threshold is preferably set to zero. Thus, if the result is positive, the indication is the presence of pitch in the signal.

The final first level decision stage is the decision combiner 98. It combines the pitch decision with the audio/no audio decision of the signal presence detector 74. If there is no audio present, then the output of the first level decision means 50 is UNS (no voice or tone) no matter what the total output of the summer 94 is. However, the VT/UNS decision as well as the pitch estimate are passed to the second level decision processor 52.

Referring again to FIG. 3, there are shown the principal elements of the second level decision means 52. The median smoother 56 looks at a given odd number of previous first level decisions and determines which of the two states is in the majority. It provides as its output a state which represents the state of the majority of the previous given odd number of the first level decisions. Thus, it is operative to eliminate noise-induced short term transitions. A median smoother of this type is in accordance with that described by L.R. Rabiner and R.W. Schafer, *Digital Processing of Speech Signals*, pp. 158–161, 1978, (Prentice-Hall, Inc, Englewood Cliffs, NJ 07632).

The pitch estimate is supplied to the tone detector 58 or more precisely to a pitch consistency detector 58 having as parametric inputs the consistency tolerance and the window width. If the pitch estimate is within the consistency tolerance for a duration longer than a fixed minimum tone duration, then a tone presence decision T is issued to the decision combiner 60.

The decision combiner 60 of the second level decision means 52 combines the smoothed output of the median smoother 56 and the Tone decision T of the tone detector 58 to generate a signal indicating that the signal is a voiced signal V or unvoiced, noise or silence (UNS), suppressing specifically frames containing tones. The V/UNS decision is provided to the decision storage means 62 of the third level decision means where speech-segment-level decisions are rendered.

Figure 5:
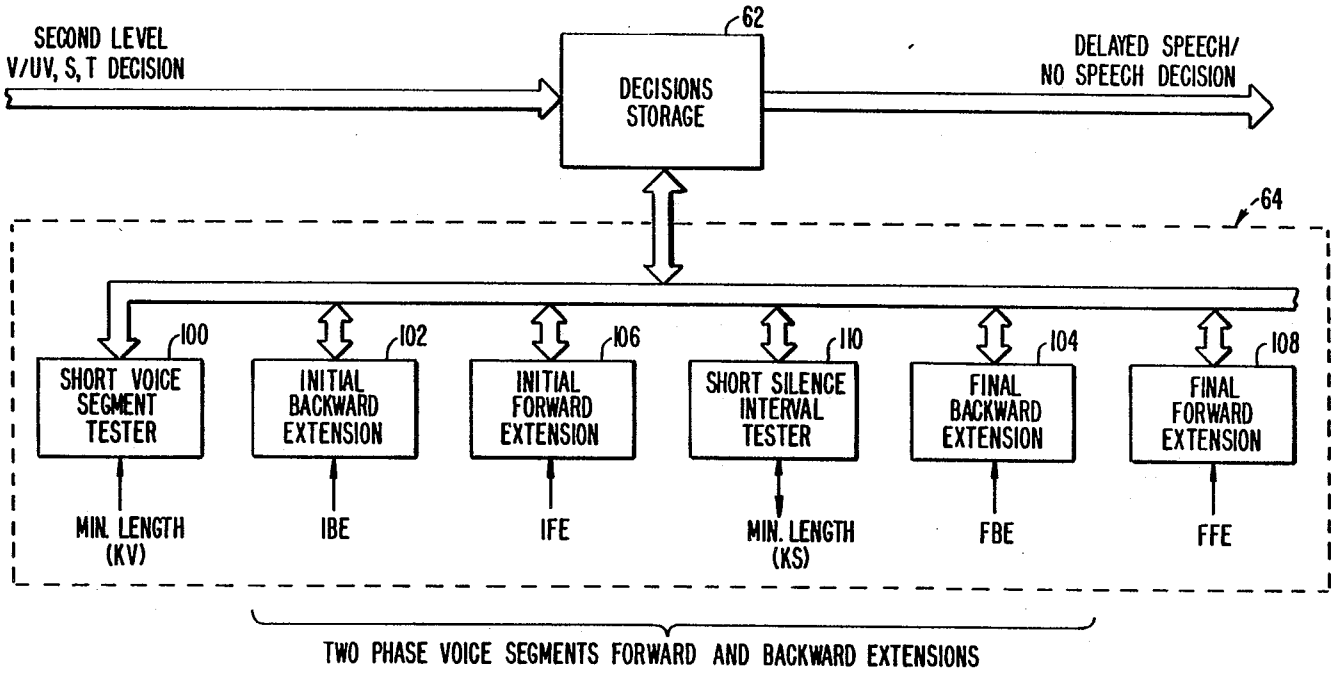
FIG. 5 is a third level decision means according to the invention.

Referring to FIG. 5, there is shown a portion of the third level decision means 54 comprising the decision storage means 62 and the decision extender/modifier 64. As previously explained, all frame decisions are captured and stored for a period of time in the decision storage means 62. Several speech-segment-level decision processes are performed on the accumulated data. First a short voice segment tester 100 is provided for deleting or changing to a UNS decision all V segments whose duration is shorter than a preselected minimum kV.

An initial backward extension 102 and a final backward extension 104 are provided for testing the backward extension in time of all voice decisions V. The purpose is to include with voiced speech segments any related unvoiced speech segments which may precede and should be passed with the speech decision. A typical extension is 5 to 10 frames. (Since the sum of the initial backward extension time and the final backward extension time have a direct impact on the time delay, care must be taken to avoid long times if a short VOX hang is desirable.)

An initial forward extension 106 and a final forward extension 108 are provided for testing the forward extension in time of all voice segments V. The purpose is to include with speech segments the any related unvoiced speech segments which may trail and should be passed with the speech decision, as well as to provide a limited amount of hang between words and sentences. The initial forward extension parameter is typically 5 frames. (Forward extensions have no impact on VOX time delay.)

A short silence interval tester 110 is also provided to convert silence intervals shorter than a preselected length kS to voiced decisions V.

The final backward extension is set typically in the range of zero to up to 15 frames. The parameter is selected on the basis of the allowable overall time delay.

The final forward extension is set to a minimum of ten frames to ensure the inclusion of unvoiced speech following detected voiced speech. The maximum is limited only by the available memory. Values of 500 ms to up to three seconds are considered sufficient for contemplated applications.

In order to augment the understanding of the invention, an appendix is provided containing schematic flow charts of the processes involved together with a step by step explanation of the processes of a specific embodiment of the invention.

The invention has now been explained with reference to specific embodiments. Other embodiments, including realizations in hardware and realizations in other preprogrammed or software forms, will be apparent to those of ordinary skill in this art. It is therefore not intended that this invention be limited except as indicated by the appended claims.

APPENDIX

Contents:

1. Flow Chart; ~~pp. 17~~

2. Explanation of Flow Chart; ~~pp. 24~~

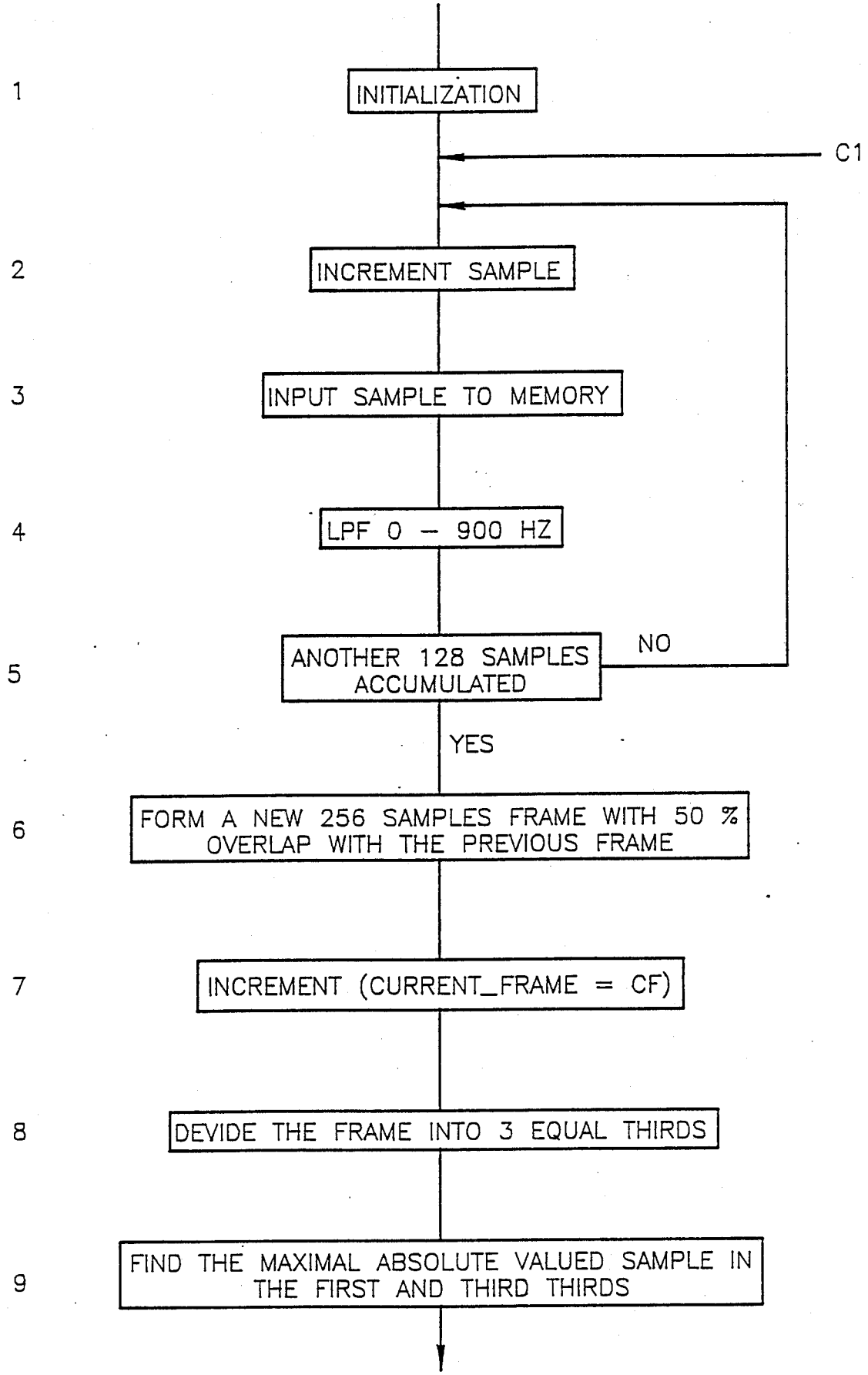
1
INITIALIZATION
C1
2
INCREMENT SAMPLE
3
INPUT SAMPLE TO MEMORY
4
LPF 0 – 900 HZ
5
ANOTHER 128 SAMPLES ACCUMULATED
NO
YES
6
FORM A NEW 256 SAMPLES FRAME WITH 50 % OVERLAP WITH THE PREVIOUS FRAME
7
INCREMENT (CURRENT_FRAME = CF)
8
DEVIDE THE FRAME INTO 3 EQUAL THIRDS
9
FIND THE MAXIMAL ABSOLUTE VALUED SAMPLE IN THE FIRST AND THIRD THIRDS

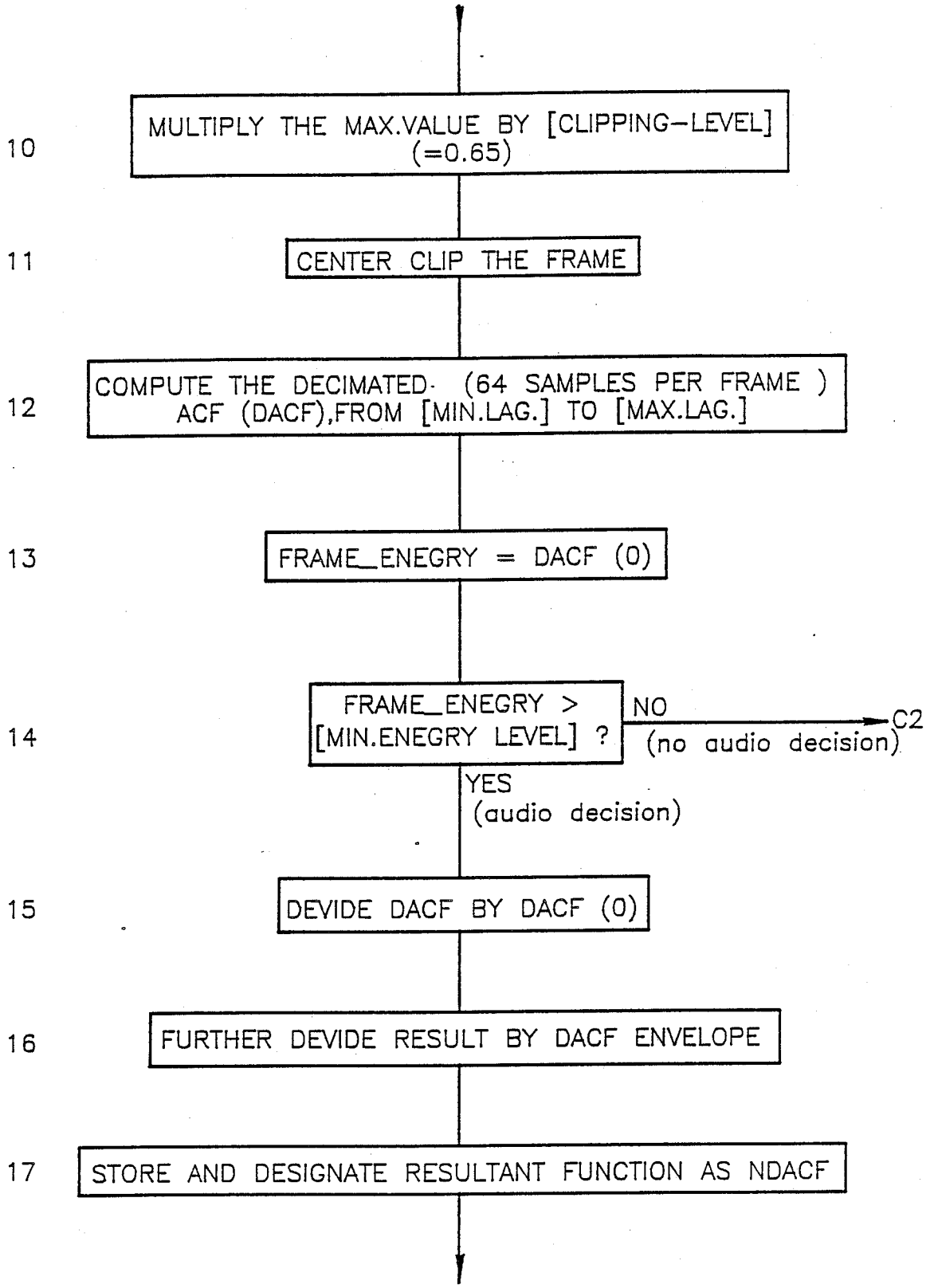
10
MULTIPLY THE MAX.VALUE BY [CLIPPING-LEVEL] (=0.65)
11
CENTER CLIP THE FRAME
12
COMPUTE THE DECIMATED (64 SAMPLES PER FRAME ) ACF (DACF),FROM [MIN.LAG.] TO [MAX.LAG.]
13
FRAME_ENEGRY = DACF (0)
14
FRAME_ENEGRY > [MIN.ENEGRY LEVEL] ?
NO
(no audio decision)
C2
YES
(audio decision)
15
DEVIDE DACF BY DACF (0)
16
FURTHER DEVIDE RESULT BY DACF ENVELOPE
17
STORE AND DESIGNATE RESULTANT FUNCTION AS NDACF

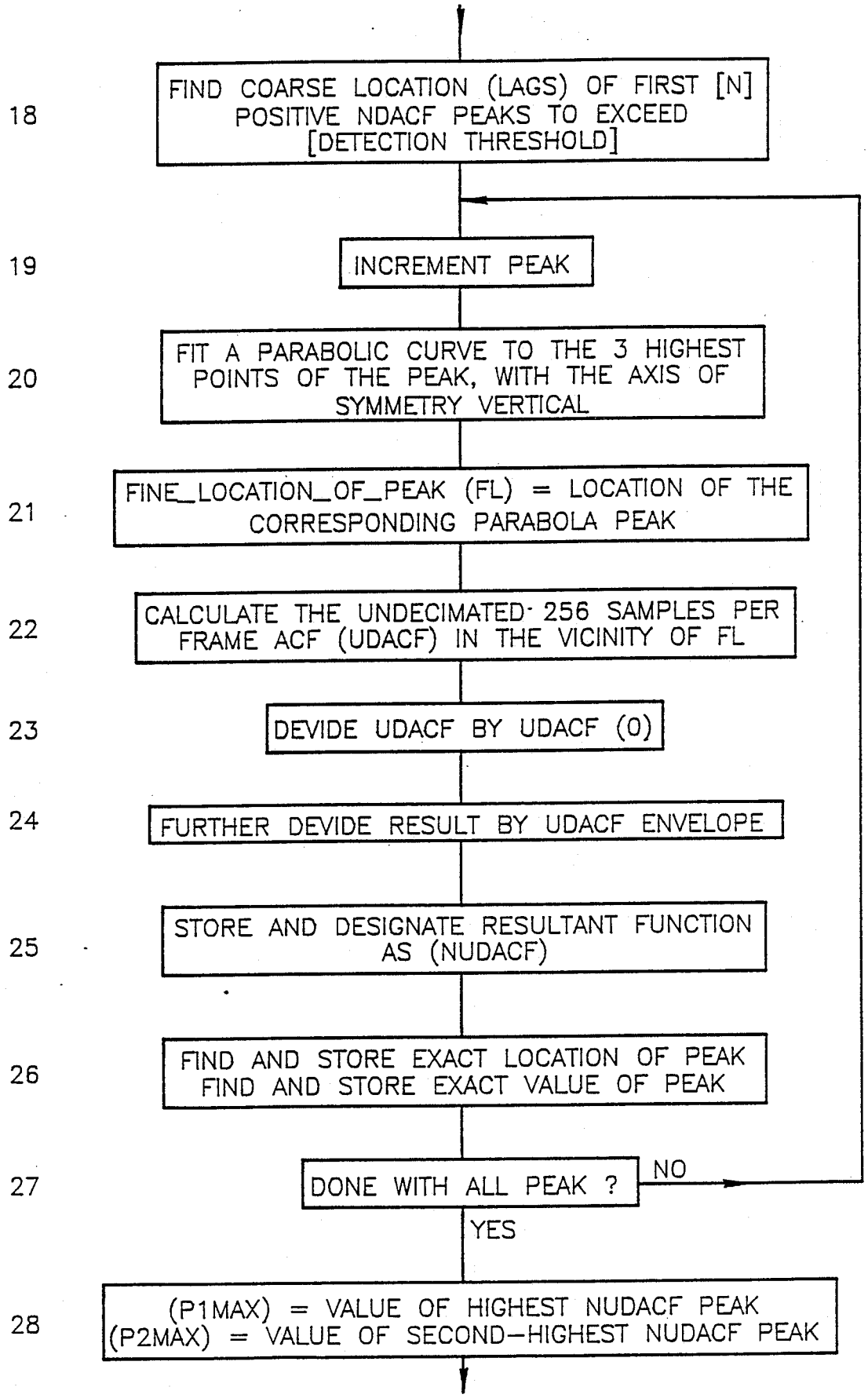
18
FIND COARSE LOCATION (LAGS) OF FIRST [N] POSITIVE NDACF PEAKS TO EXCEED [DETECTION THRESHOLD]
19
INCREMENT PEAK
20
FIT A PARABOLIC CURVE TO THE 3 HIGHEST POINTS OF THE PEAK, WITH THE AXIS OF SYMMETRY VERTICAL
21
FINE_LOCATION_OF_PEAK (FL) = LOCATION OF THE CORRESPONDING PARABOLA PEAK
22
CALCULATE THE UNDECIMATED 256 SAMPLES PER FRAME ACF (UDACF) IN THE VICINITY OF FL
23
DEVIDE UDACF BY UDACF (0)
24
FURTHER DEVIDE RESULT BY UDACF ENVELOPE
25
STORE AND DESIGNATE RESULTANT FUNCTION AS (NUDACF)
26
FIND AND STORE EXACT LOCATION OF PEAK
FIND AND STORE EXACT VALUE OF PEAK
27
DONE WITH ALL PEAK ?
NO
YES
28
(P1MAX) = VALUE OF HIGHEST NUDACF PEAK
(P2MAX) = VALUE OF SECOND-HIGHEST NUDACF PEAK

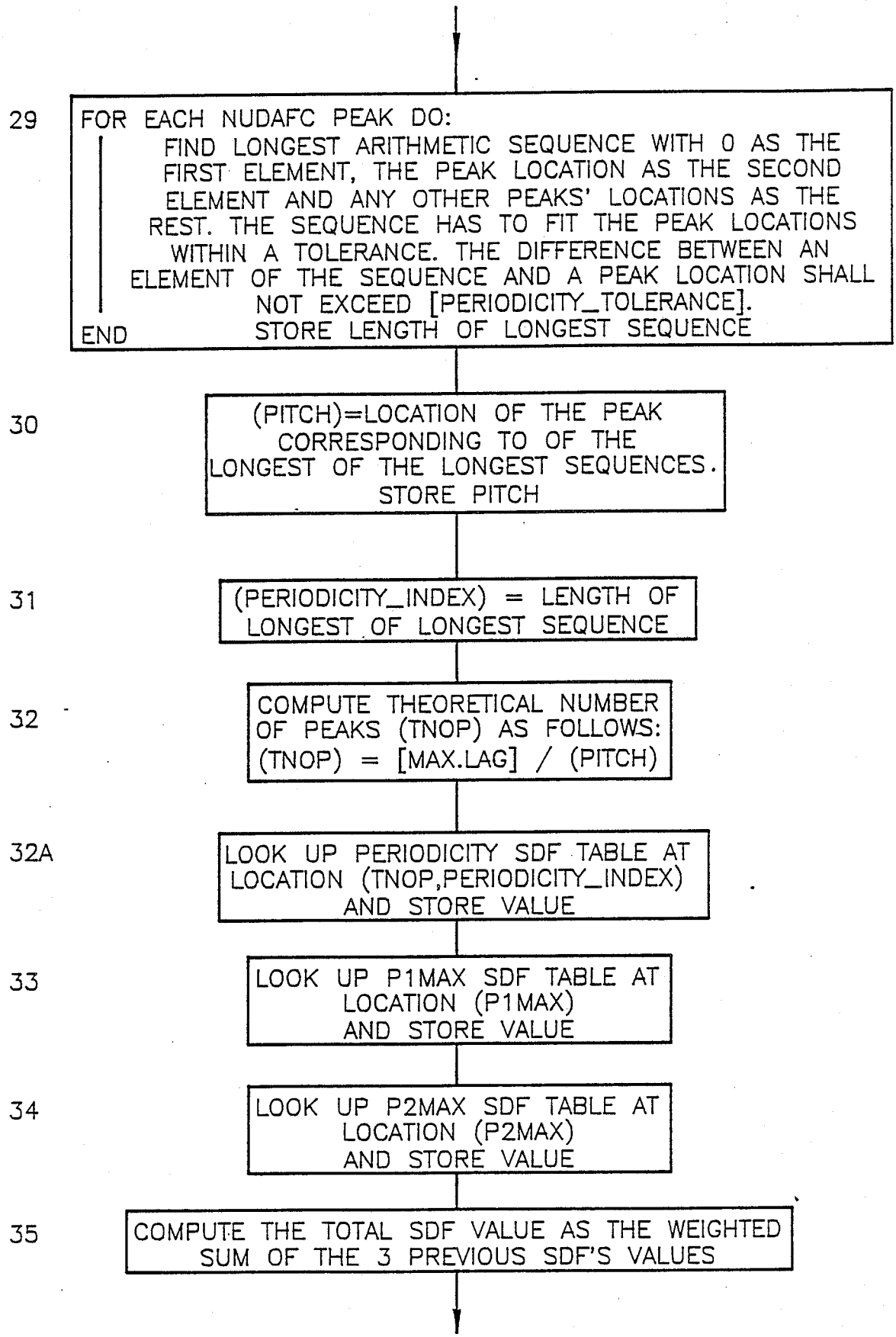
29
FOR EACH NUDAFC PEAK DO:
FIND LONGEST ARITHMETIC SEQUENCE WITH 0 AS THE FIRST ELEMENT, THE PEAK LOCATION AS THE SECOND ELEMENT AND ANY OTHER PEAKS' LOCATIONS AS THE REST. THE SEQUENCE HAS TO FIT THE PEAK LOCATIONS WITHIN A TOLERANCE. THE DIFFERENCE BETWEEN AN ELEMENT OF THE SEQUENCE AND A PEAK LOCATION SHALL NOT EXCEED [PERIODICITY_TOLERANCE].
END
STORE LENGTH OF LONGEST SEQUENCE
30
(PITCH)=LOCATION OF THE PEAK CORRESPONDING TO OF THE LONGEST OF THE LONGEST SEQUENCES.
STORE PITCH
31
(PERIODICITY_INDEX) = LENGTH OF LONGEST OF LONGEST SEQUENCE
32
COMPUTE THEORETICAL NUMBER OF PEAKS (TNOP) AS FOLLOWS:
(TNOP) = [MAX.LAG] / (PITCH)
32A
LOOK UP PERIODICITY SDF TABLE AT LOCATION (TNOP,PERIODICITY_INDEX) AND STORE VALUE
33
LOOK UP P1MAX SDF TABLE AT LOCATION (P1MAX) AND STORE VALUE
34
LOOK UP P2MAX SDF TABLE AT LOCATION (P2MAX) AND STORE VALUE
35
COMPUTE THE TOTAL SDF VALUE AS THE WEIGHTED SUM OF THE 3 PREVIOUS SDF'S VALUES

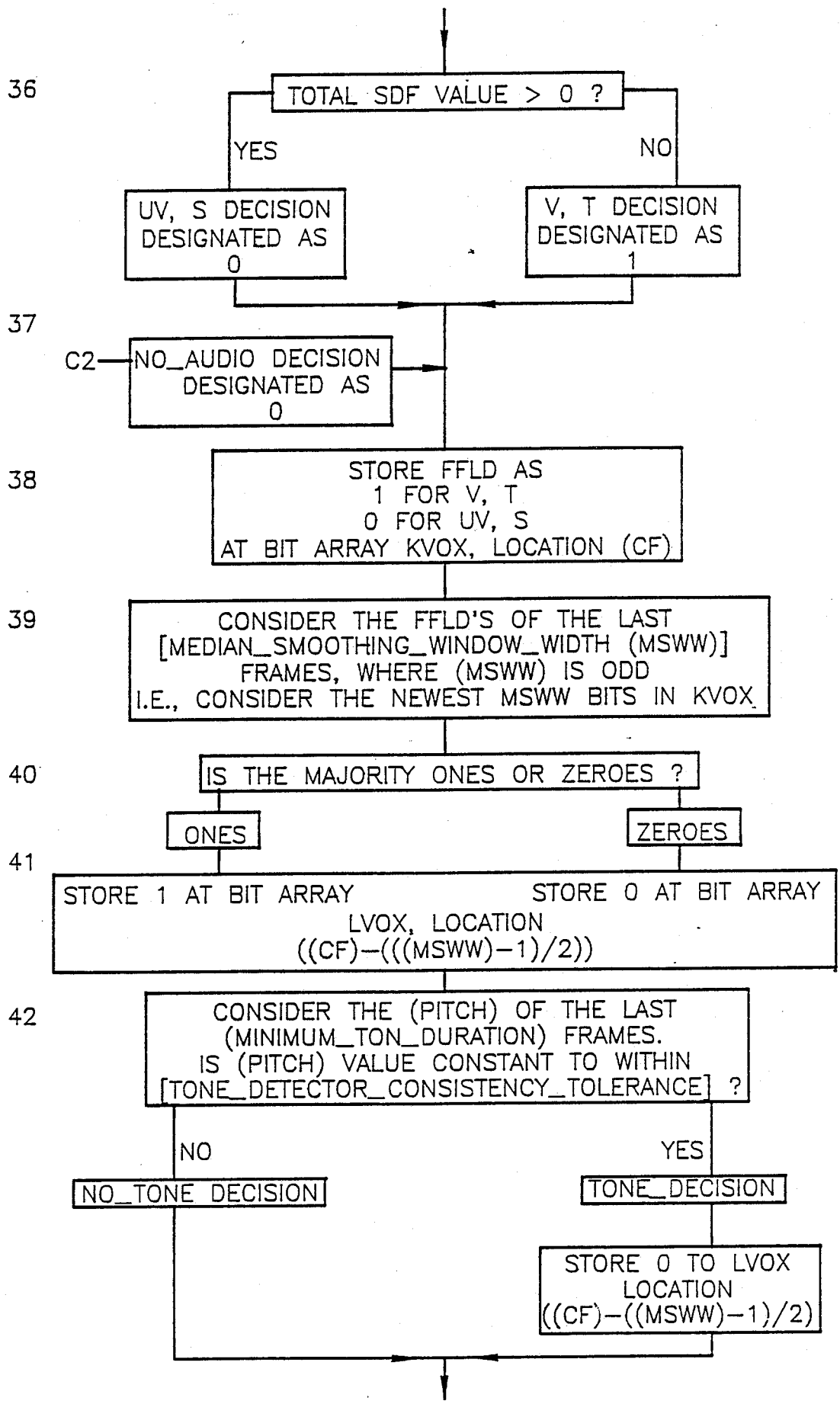
36
TOTAL SDF VALUE > 0 ?
YES
NO
UV, S DECISION DESIGNATED AS 0
V, T DECISION DESIGNATED AS 1
37
C2
NO_AUDIO DECISION DESIGNATED AS 0
38
STORE FFLD AS 1 FOR V, T 0 FOR UV, S AT BIT ARRAY KVOX, LOCATION (CF)
39
CONSIDER THE FFLD'S OF THE LAST [MEDIAN_SMOOTHING_WINDOW_WIDTH (MSWW)] FRAMES, WHERE (MSWW) IS ODD I.E., CONSIDER THE NEWEST MSWW BITS IN KVOX
40
IS THE MAJORITY ONES OR ZEROES ?
ONES
ZEROES
41
STORE 1 AT BIT ARRAY
STORE 0 AT BIT ARRAY
LVOX, LOCATION ((CF)−(((MSWW)−1)/2))
42
CONSIDER THE (PITCH) OF THE LAST (MINIMUM_TON_DURATION) FRAMES. IS (PITCH) VALUE CONSTANT TO WITHIN [TONE_DETECTOR_CONSISTENCY_TOLERANCE] ?
NO
YES
NO_TONE DECISION
TONE_DECISION
STORE 0 TO LVOX LOCATION ((CF)−((MSWW)−1)/2)

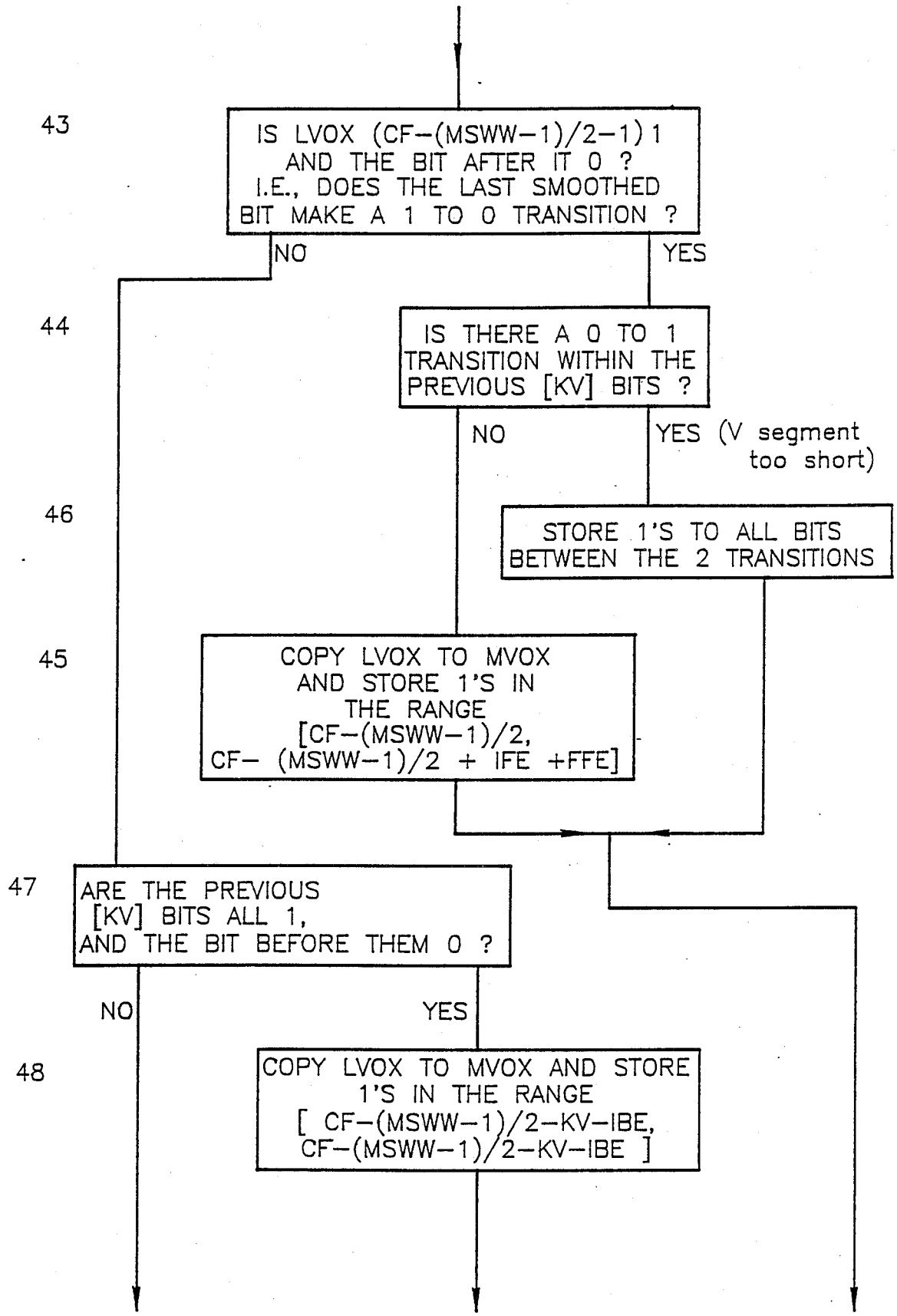
43
IS LVOX (CF−(MSWW−1)/2−1) 1 AND THE BIT AFTER IT 0 ? I.E., DOES THE LAST SMOOTHED BIT MAKE A 1 TO 0 TRANSITION ?
NO
YES
44
IS THERE A 0 TO 1 TRANSITION WITHIN THE PREVIOUS [KV] BITS ?
NO
YES (V segment too short)
46
STORE 1'S TO ALL BITS BETWEEN THE 2 TRANSITIONS
45
COPY LVOX TO MVOX AND STORE 1'S IN THE RANGE [CF−(MSWW−1)/2, CF− (MSWW−1)/2 + IFE +FFE]
47
ARE THE PREVIOUS [KV] BITS ALL 1, AND THE BIT BEFORE THEM 0 ?
NO
YES
48
COPY LVOX TO MVOX AND STORE 1'S IN THE RANGE [ CF−(MSWW−1)/2−KV−IBE, CF−(MSWW−1)/2−KV−IBE ]

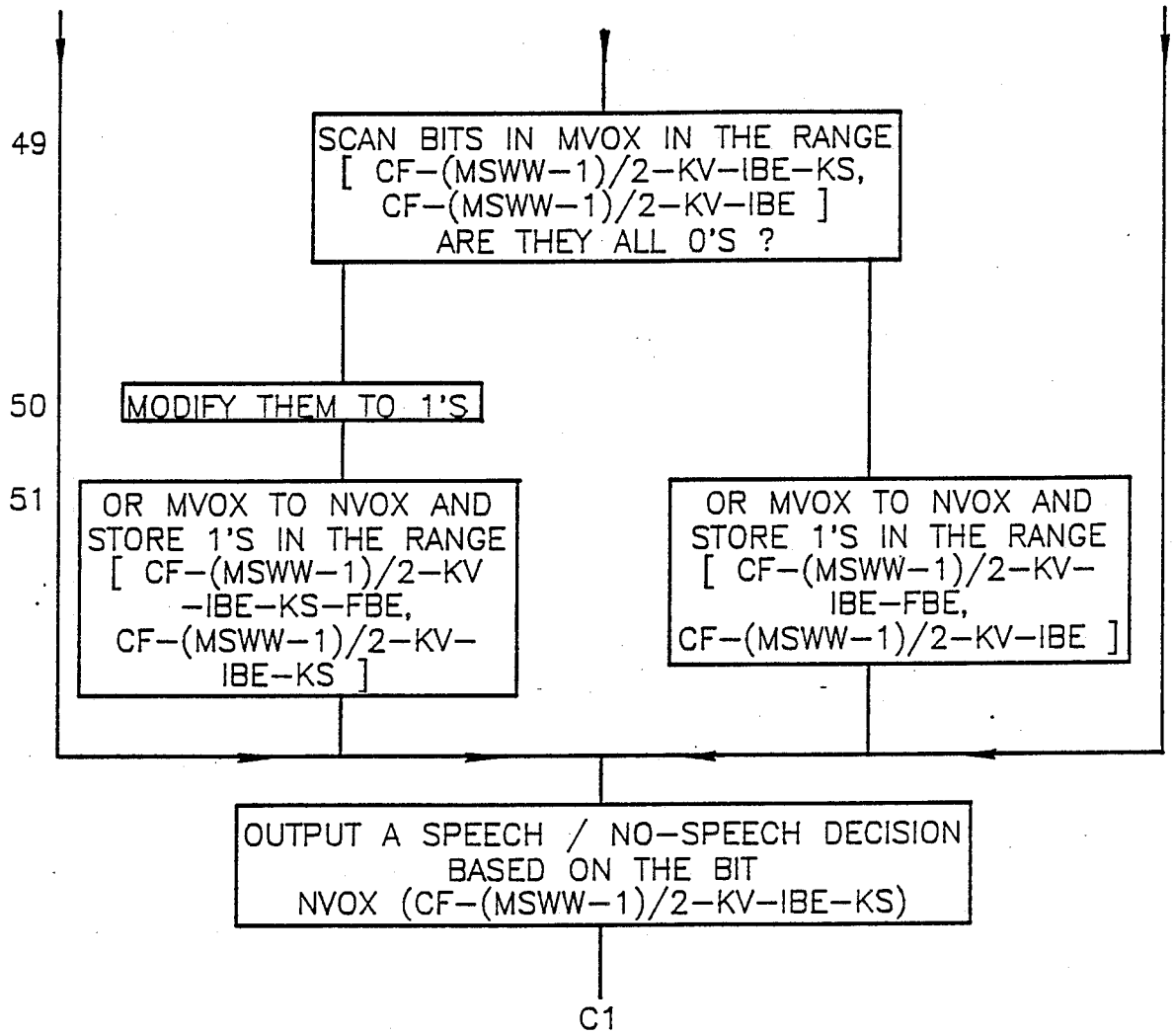
49
SCAN BITS IN MVOX IN THE RANGE [ CF−(MSWW−1)/2−KV−IBE−KS, CF−(MSWW−1)/2−KV−IBE ] ARE THEY ALL 0'S ?
50
MODIFY THEM TO 1'S
51
OR MVOX TO NVOX AND STORE 1'S IN THE RANGE [ CF−(MSWW−1)/2−KV −IBE−KS−FBE, CF−(MSWW−1)/2−KV− IBE−KS ]
OR MVOX TO NVOX AND STORE 1'S IN THE RANGE [ CF−(MSWW−1)/2−KV− IBE−FBE, CF−(MSWW−1)/2−KV−IBE ]
OUTPUT A SPEECH / NO−SPEECH DECISION BASED ON THE BIT NVOX (CF−(MSWW−1)/2−KV−IBE−KS)
C1

2.2.6.3 EXPLANATION OF FLOW CHART 1,2,3,4

This is the sampling and low-pass-filtering block.

5,6,7

Whenever another 128 samples accumulated, a new 256 50% overlapping frame is formed.

8,9,10,11

Center Clipping:

12

Compute the Decimated 64 samples per frame Auto-Correlation-Function (DACF). The lag varies from [MIN. LAG] to [MAX. LAG].

13

The DACF with lag 0 is the frame energy.

14

Compare the frame energy to a threshold to obtain an Audio / No Audio decision.

15

Normalize the DACF by the frame energy.

16,17

The ACF has a triangular envelope, because less terms are included in the sum as the lag is increased. The DACF is therefore divided by this envelope. The resultant function is designated NDACF. NDACF (0) = 1.

18

A peak is a point that is greater than its two neighbors. Only peaks that exceed the threshold are considered. Only the first [n] peaks to exceed threshold are considered.

19,20,21,22,23,24,25,26,27

This is a loop. Its purpose is to find the exact lag and value of all the peaks detected in 18. A vertical parabola is fitted to the 3 highest points of the peak. The lag of the axis of symmetry of the parabola gives an approximation of the peak lag. Then the ACF is recalculated using all 256 samples of the frame to obtain a better accuracy. This ACF is designated as UDACF, and is calculated around the approximate location of the peak. The UDACF is then normalized in the same way as the DACF was normalized, yielding NUDACF. Finally, the exact location and value of each peak are stored.

28

P1MAX is the value of the highest NUDACF peak, and P2MAX is the value of the second-highest NUDACF peak.

29

The purpose of this block is to measure how closely some of the peaks' locations resemble an arithmetic sequence with zero as the first element of the sequence. The procedure is as follows:

```
The first peak, i.e. the one with smallest
     lag is, selected.
This lag is now considered a difference of an
     arithmetic sequence, designated by D.
Is there a peak at lag 2*D plus or minus
                [ periodicity_tolerance ]?
     If no, the longest sequence corresponding to
          the first peak is 1.
     If yes, is there another peak at lag 3*D
          (within tolerance)?
          If no, then the longest sequence
               corresponding to the first peak is
               2.
          If yes, is there another peak at 4*D
               ... and so on until the length of
               the longest sequence corresponding
               to the first peak is determined.
Select the second peak, and repeating the
     above procedure, determine the length of the
     longest sequence corresponding to the second
     peak.
In the same manner, determine the length of
     the longest sequences corresponding to
     subsequent peaks.
Store the lengths of all longest sequences.
```

30

(Pitch) is defined as the difference of the longest of all the longest sequences.

(Periodicity _ Index) is the length of the longest sequence of all the longest sequences corresponding to any peak.

32

The theoretical number of peaks (TNPO) is the number of peaks that should have been if the frame was a truly periodic waveform with a (PITCH) fundamental frequency, and the ACF is calculated with a maximum lag of (MAX.LAG>).

32a, 33, 34

Tables are looked up using P1MAX, P2MAX, TNPO and PERIODICITY_INDEX. The periodicity Soft-Decision-Function table is two dimensional.

35

The weights are parameters of the algorithm and . Their value can be optimized for specific applications.

36

38

From now on each frame is represented by a bit, where 1 means V,T and O means U,N or S. There is an endless array of such bits called KVOX. It is implemented in software as a cyclic buffer.

39, 40, 41

This block performs the median smoothing function. The output of the Median Smoother is stored to a new bit array LVOX. The reason for storing processed decisions into a new bit array ratherg than into the same array is simply to preserve the unprocessed decisions for the next Median-Smoothing-Window.

This block is the Tone-Detector.

43, 44, 45, 46

This block kills too short voiced segments. When a 1 to 0 transition is detected (43) in LVOX ( i.e., in the median smoothed decision), the previous [KV] bits are scanned for a 0 to 1 transition (44); if there was one, then the voiced segment is too short and therefore eliminated by modifying the 1's between the transitions to '0's (46). If there was no such transition, then the voiced segment is long enough and therefore (45) is forward extended by [IFE] + [FFE] frames, after being copied to bit array MVOX.

47, 48

This block detects the case where exactly [KV] '1' contigous bits have been accumulated, and backwards extend the '1's by [IBE] which is the initial backwards extension.

49, 50

This block kill too short silence segments.

51

This block performs the Final-Backward-Extension (FBE). Note that MVOX is OR'ed to NVOX, and that NVOX is operated by the Kill-Voice or Kill-Silence blocks. This procedure ensures that final extensions cannot be deleted.

60

A final decision is output based on the bit array NVOX

We claim:

1. A method for indicating the presence of speech in an audio signal in each of a plurality of time invariant frames, said method comprising the steps of:

digitizing, low pass filtering and clipping an input audio signal to obtain a digitized, filtered and clipped signal;

thereafter autocorrelating the clipped signal to obtain an autocorrelation function ACF for each of said plurality of frames; thereafter (1) examining said ACF of each of said plurality of frames for the presence of peaks indicative of pitch to obtain a pitch/no pitch decision for each of said plurality of frames, said examining step comprising the steps of:

determining the amplitude of the highest ACF peak;

determining the amplitude of the second highest ACF peak; and determining the periodicity of ACF peaks within each of said plurality of frames, whose amplitudes exceed a predetermined threshold, noting how many ACF peaks having he determined periodicity are detected; and providing a pitch/no pitch decision based on a weighted sum of non-linear functions of the amplitudes of the highest and second highest ACF peak and the number of detected ACF peaks having the determined periodicity;

(2) analyzing said ACF of each of said plurality of frames to detect for a tone in said frame to obtain a tone/no-tone decision for said frame; and rendering a speech/no-speech decision for said frame, providing a speech decision upon coincidence of a pitch decision with a no-tone decision.

2. The method of claim 1 further including the step of overlappingly segmenting said frames after said digitizing step.

3. The method according to claim 1 wherein said autocorrelation step includes normalizing said autocorrelation function.

4. The method according to claim 3 wherein said examining step comprises:

obtaining a first preliminary quantitative value corresponding to a first likelihood of pitch detection, and comparing said second highest ACF peak with a second threshold to obtain a second preliminary quantitative value corresponding to a second likelihood of pitch detection.

5. The method according to claim 4 wherein said analyzing step further includes detecting for a consistent tone over a plurality of frames for application in said rendering step.

6. The method according to claim 1 further including the step, prior to said rendering step, of smoothing pitch/no-pitch decisions over a plurality of frames to suppress excessive transitions between pitch and no-pitch decisions.

7. The method according to claim 1 further including the steps of storing a plurality of speech/no-speech decisions to accumulate a sufficient number to produce speech-segment-level decisions, and producing speech-segment-level decisions of sufficient duration to include unvoiced speech preceding and following voiced speech.

8. An apparatus for indicating the presence of speech in an audio signal comprising:

a digital low-pass filter and clipping means coupled to filter time-invariant frames of an audio input signal;

means coupled to receive signals processed by said filter and clipping means for obtaining an autocorrelation function for each of a plurality of said frames of said audio signal;

means coupled to process said autocorrelation function for detecting peaks indicative of the presence of pitch of each of said frames of said audio in put signal, said processing means comprising:

a first peak decision processor for determining the amplitude of the highest ACF peak;

a second peak decision processor for determining the amplitude of the second highest ACF peak; and a periodicity detector means for determining the periodicity of ACF peaks within each of said plurality of frames, whose amplitude exceeds a predetermined threshold, noting how many ACF peaks having the determined periodicity are detected; and providing a pitch/no pitch decision based on a weighted sum of non-linear functions of the amplitudes of the highest and second highest ACF peak and the number of detected ACF peaks having the determined periodicity;

means for analyzing said ACF of each of said plurality of frames to detect a tone in each of said plurality of frames and to obtain a tone/no tone decision for said frame;

an autocorrelation function periodicy detection means coupled to process said autocorrelation function for detecting the presence of pitch and tone in said audio input signal; and decision combining means coupled to receive a pitch-/no-pitch decision and a tone/no-tone decision for indicating the presence of voice speech upon coincidence of a no-tone decision and a pitch decision.

9. The apparatus according to claim 8 further including speech-segment-level decision means responsive to the output of said decision combining means indicating the presence of voice speech in a given frame, said speech-segment-level decision means including means for capturing and processing a sufficient number of frames to produce speech-segment-level decisions, including an initial backward extension means, an initial forward extension means, a final backward extension means, a final forward extension means, a short voice segments testing means and a short silence interval testing means, said extension means and said testing means for expanding a time base of said speech-segment-level decision means to include unvoiced speech and gaps between words.

10. The apparatus according to claim 9 further including means for synchronizing said speech-segment-level decisions with corresponding speech segments.

11. The apparatus according to claim 8 further including means for segmenting said frames into time-overlapping frames.

* * * * *